US007124917B2

(12) United States Patent
Lee

(10) Patent No.: US 7,124,917 B2
(45) Date of Patent: Oct. 24, 2006

(54) SPOUT ASSEMBLY HAVING A PLURALITY OF FLUID PASSAGES

(76) Inventor: Jung Min Lee, 1208 Misung Apt. A-dong, 37 Yeoueudo-dong, Youngdungpo-gu, Seoul (KR) 150-010

( * ) Notice: Subject to any disclaimer, the term of this patent is extended or adjusted under 35 U.S.C. 154(b) by 153 days.

(21) Appl. No.: 10/275,231

(22) PCT Filed: May 3, 2001

(86) PCT No.: PCT/KR01/00726

§ 371 (c)(1),
(2), (4) Date: Nov. 4, 2002

(87) PCT Pub. No.: WO02/26583

PCT Pub. Date: Apr. 4, 2002

(65) Prior Publication Data

US 2003/0102318 A1 Jun. 5, 2003

(30) Foreign Application Priority Data

May 3, 2000 (KR) ..... 2000-24762
Jul. 25, 2000 (KR) ..... 2000-43911
Aug. 3, 2000 (KR) ..... 2000-45139
Aug. 6, 2000 (KR) ..... 2000-46012

(51) Int. Cl.
*B65D 3/00* (2006.01)

(52) U.S. Cl. ..... 222/485; 222/541.5; 222/464.3; 222/529; 220/710

(58) Field of Classification Search ..... 222/74, 222/111, 464.3, 481.5, 527, 529, 464.2, 464, 222/539, 541.5, 464.1, 485, 487, 541.6, 541.9; 220/710

See application file for complete search history.

(56) References Cited

U.S. PATENT DOCUMENTS 2,432,132 A * 12/1947 Allen ..... 215/229
3,291,331 A * 12/1966 Grisham et al. ..... 215/388
3,369,718 A * 2/1968 Libit et al. ..... 222/481.5
4,251,019 A * 2/1981 Cone ..... 229/103.1
4,537,324 A * 8/1985 Wang ..... 220/706
4,732,303 A * 3/1988 Wang ..... 222/484
5,160,058 A * 11/1992 Ahn ..... 215/388
5,687,872 A * 11/1997 Nmngani ..... 220/710
6,076,729 A * 6/2000 Cornell et al. ..... 229/103.1
6,161,728 A * 12/2000 Dark ..... 222/83

* cited by examiner

*Primary Examiner*—Kevin Shaver
*Assistant Examiner*—Melvin A. Cartagena
(74) *Attorney, Agent, or Firm*—Norris McLaughlin & Marcus PA

(57) ABSTRACT

The present invention relates to a spout assembly having a plurality of fluid passages so as to enable easy and convenient drinking of liquid beverages contained in the container through an associated straw and easily dispense the liquid beverages into another container. The spout assembly includes a main body coupled on a top of a container, a fluid spout assembly having a first fluid passage through which the liquid beverage can flow out of the container in a state where the container is inclined and a second fluid passage through which the liquid beverage can be socked in a state where the container vertically stands; and a cap coupled to the fluid spouting assembly. The fluid spout assembly can be folded on a folding portion or be elected so that the user can drink or dispense the liquid beverages.

23 Claims, 22 Drawing Sheets

SPOUT ASSEMBLY HAVING A PLURALITY OF FLUID PASSAGES

TECHNICAL FIELD

The present invention relates to a spout assembly having a plurality of fluid passage that is designed to enable easy and convenient drinking of liquid contained in a container through an sucking passage, and easily dispense the liquid into another container through an exhausting passage, and an outflow means including the sucking passage and the exhausting passage can be bent in a direction.

BACKGROUND ART

Generally, many kinds of beverage containers are used for a liquid beverage. The beverage container is composed of a cap and a container and the user can open the cap and then suck the beverage with a straw or drink it. However, it is unsanitary because the contact portion with human mouse can easily polluted. Though the user can use a straw, it is not convenient to provide when it is needed.

Korean Utility Model Registration Nos. 20-176923 and 20-193549 disclose a container having a straw. As the container of the prior art is designed for sucking the beverage, it is impossible or is not convenient to dispense the beverage of the container to another container like a cup. The disclosed beverage container is designed such that the upper end of the straw is exposed to the atmosphere.

DISCLOSURE OF INVENTION

Therefore, the present invention has been made in an effort to solve the problem. It is an objective of the present invention to provide a spout assembly having a plurality of fluid passage thereby easily and conveniently sucking the beverage and dispensing the beverage to another container like a cup.

It is another object of the present invention to provide a spout assembly having a plurality of fluid passage that is designed such that a protruding fluid passage can be folded thereby preventing the pollution of a mouse contact portion.

To achieve the above objects, the present invention provides a spout assembly having a plurality of fluid passages comprising: a main body coupled on an opening of a container; an outflow means having a first fluid passage through which the liquid beverage can flow out of the container in a state where the container is inclined and a second fluid passage through which the liquid beverage can be sucked in a state where the container vertically stands; a cap coupled to the outflow means; and a bending means where the outflow means can be bent or be erected so that the user can easily drink or dispense the liquid beverages.

The main body includes an opening identification skirt which is divided by a separating guide line and is provided with an engagement jaw engaged and fixed to a top end of the container.

Preferably, the main body includes an inserting groove where the top end of the container is inserted and seal-coupled, or adheres to the container, or is integrally molded by an inserting manner to the top end of the container, or is integrally molded with the container.

The main body is provided with a space for receiving the outflow means bent by the bending means. The main body is provided with an elastic protrusion for preventing the cap and the outflow means from being erected while bent to the side wall of the space and the elastic protrusion has a suitable size to elastically-pass the cap.

The first fluid passage is protrudently extended from the main body to the outside, and the spout assembly includes a spout formed with a central hole for discharging internal contents. The spout is formed at its inside with an air inflow hole.

Preferably, the second fluid passage includes a small diameter of an outflow tube mounted inside of the first fluid passage, and the outflow tube communicates from the top end of the first fluid passage to the bottom end of the container. The outflow tube is formed with a bellows bending portion. The outflow tube is made from a flexible synthetic resin. The outflow tube is composed of an upper outflow tube and a straw inserted thereinto, and the straw is formed with the bellows bending portion.

In another embodiment of the invention, The second fluid passage is supported by a supporting means in the first fluid passage and includes an operating outflow tube upward or downward movably mounted thereto, the operating outflow tube communicates from the top end of the first fluid passage to the bottom end of the container, an outer protrusion of the top end of the operating outflow tube is elastically engaged and fixed with an inner protrusion of the cap whereby the operating outflow tube moves upwardly by a fixed distance while opening the cap. The operating outflow tube is formed with the bellows bending portion. The operating outflow tube is made from the flexible synthetic resin.

The cap is threaded with an outer circumference of the outflow means and includes an opening identification skirt that is divided by a separating guide line and is provided with an engagement jaw engaged and fixed to the main body.

Preferably, the bending means includes a bellows bending portion formed on the outflow means.

The bending means includes a bending margin portion that is connected between the main body and the outflow means to accomplish of bending the outflow means and a bending border portion that is connected between an opposite main body from the bending margin portion and the outflow means thereby being a bending axis of the outflow means. The bending margin portion is formed with a folding portion.

The bending margin portion, is connected between a side wall forming a concave space of the main body and the outflow means, and is composed of a bottom surface of the concave space and the side wall while the outflow means is bent in a direction. The bending margin portion is upwardly protruded from an end portion of the main body, and the outflow means is tilted while it is bent. A fixing sticker is stuck to the outflow means and the top surface of the main body.

BRIEF DESCRIPTION OF DRAWINGS

The accompanying drawings, which are incorporated in and constitute a part of the specification, illustrate an embodiment of the invention, and, together with the description, serve to explain the principles of the invention.

BEST MODE FOR CARRYING OUT THE INVENTION

A preferred embodiment of the present invention will be described in detail with reference to the accompanying drawings.

FIRST EMBODIMENT

FIGS. 1 to 4 shows a spout assembly in a first embodiment according to the present invention.

A spout assembly having a plurality of fluid passages according to the present invention comprises a main body 100 coupled or adheres to an opening of a container C, an outflow means 200 having a first fluid passage through which the liquid beverage can flow out of the container C in a state where the container C is inclined and a second fluid passage through which the liquid beverage can be sucked in a state where the container C vertically stands, a cap 300 coupled to the outflow means 200; and a bending means where the outflow means 200 can be bent or be erected so that the user can easily drink or dispense the liquid beverages.

Figure 5:
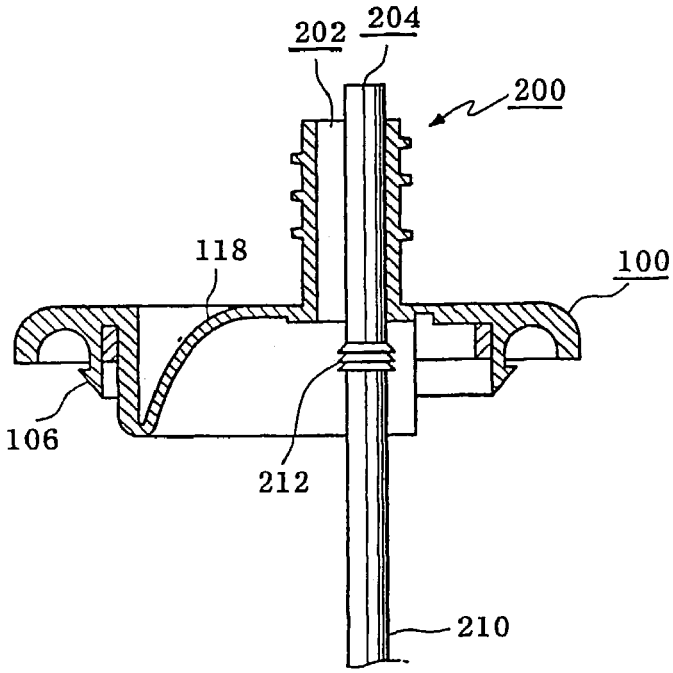
FIGS. 5 to 10 are perspective views and sectional views where a spout assembly of a first embodiment is coupled to a container.

The main body 100 is provided with an inserting groove 104 in which an annular protrusion 2 formed on an upper end opening of the container C is inserted. As another structure of the inserting groove 104 shown in FIG. 5, a fixing jaw 106 is formed on an inner circumference of the main body 100 and the annular protrusion 2 is inserted and coupled thereinto.

Figure 6:
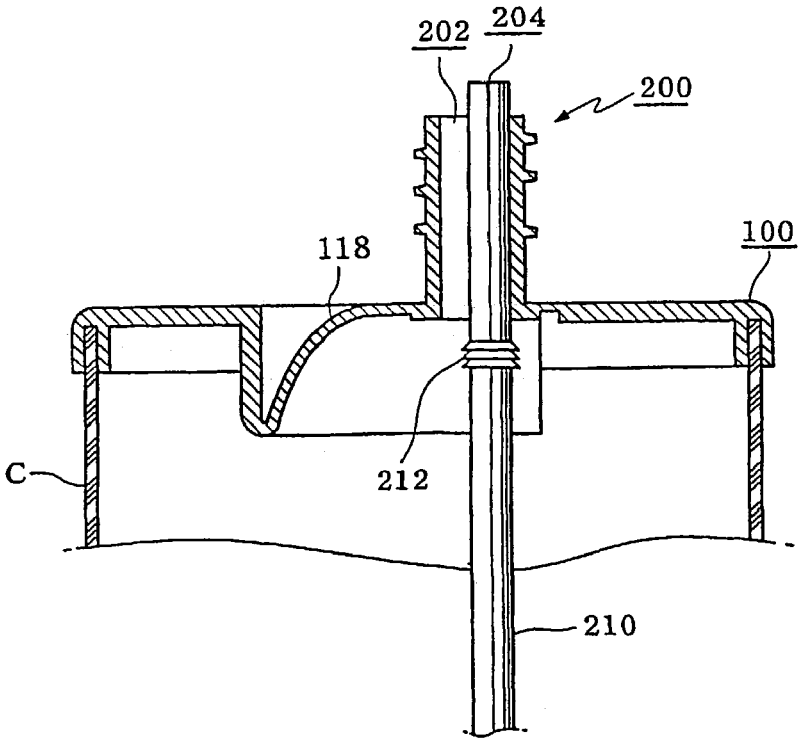
Figure 7:
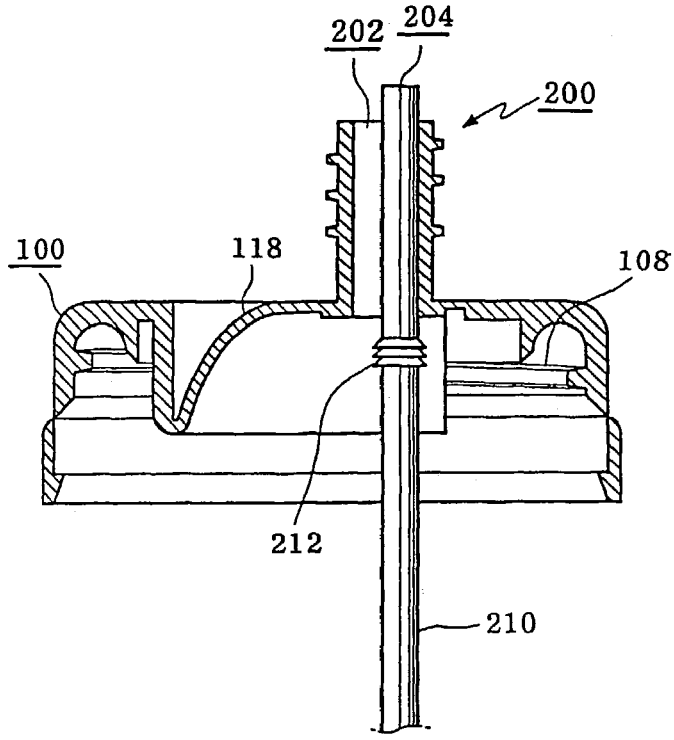
Figure 8:
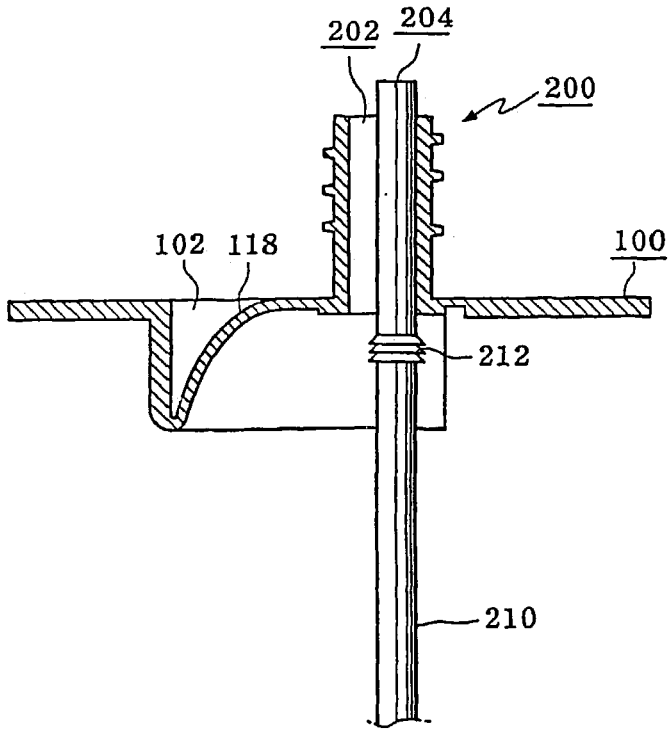
Figure 9:
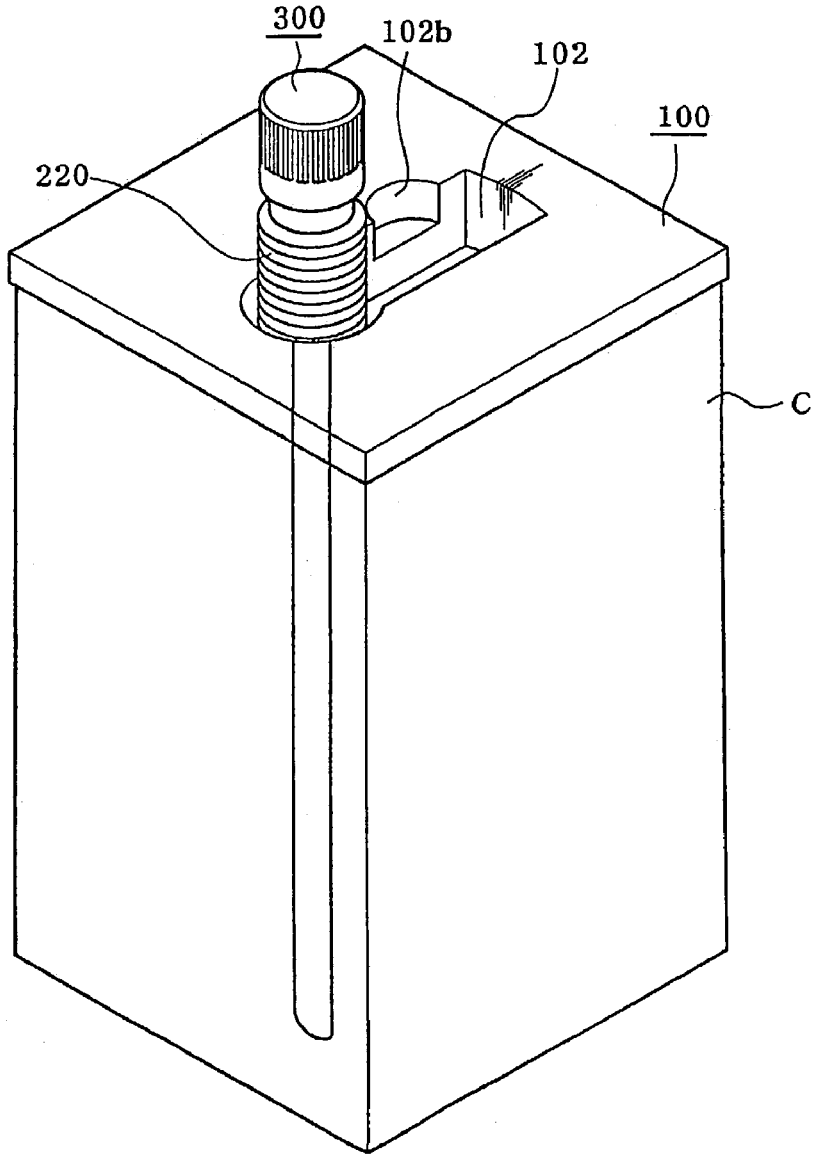
Figure 10:
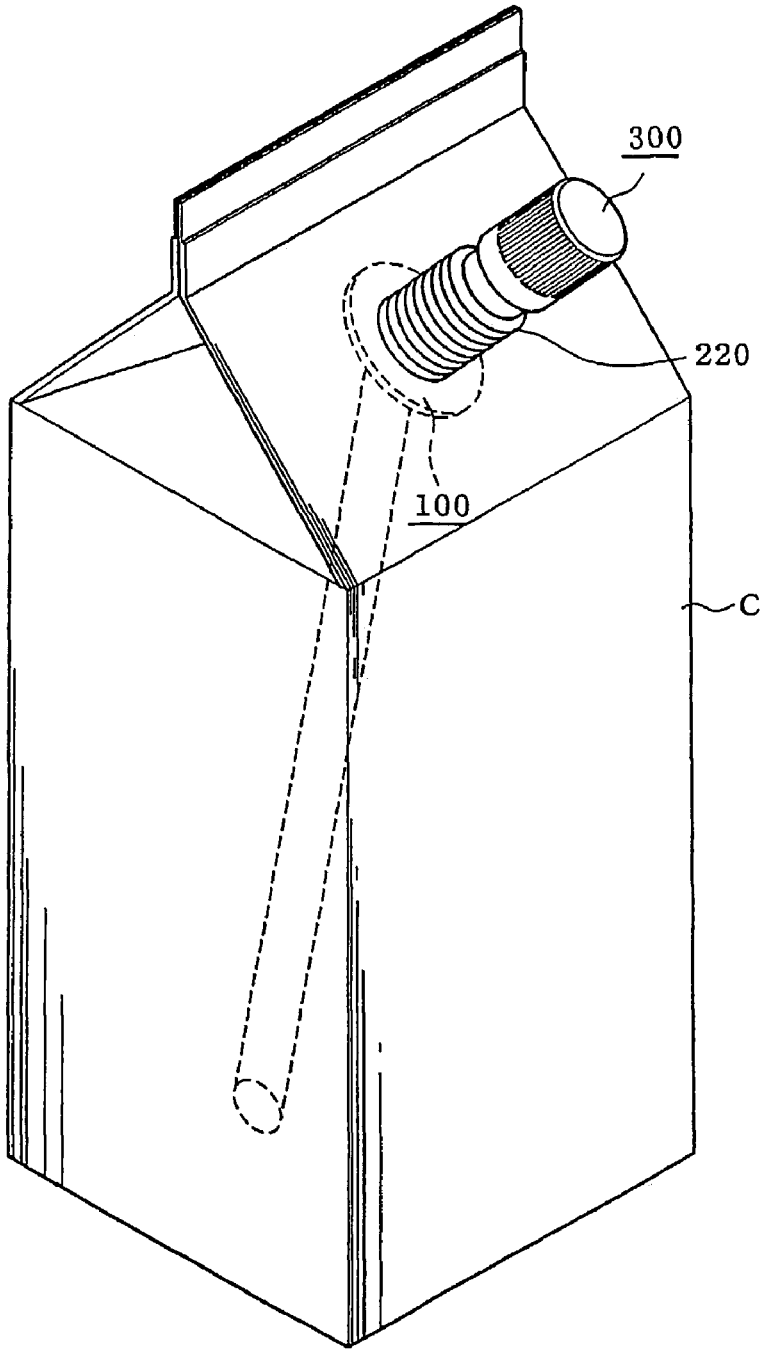

Further, as shown in FIG. 6, the main body 100 is integrally formed on the upper end of the container C by inserting manner. In FIG. 7, the main body 100 is provided with a thread 108 and is threaded with an outer circumference of the opening of the beverage container C. In FIGS. 8 to 10, the main body 100 can be adhere to an upper end of the container C or sealed by a heat pressing.

The main body 100 is provided with an opening identification skirt 112 divided by a cutting line 110. The opening identification skirt 112 is provided with an engagement jaw 114 fixed to a protrusion 4 formed on an outer circumference of the upper end of the container C.

The outflow means 200 is provided with a first fluid passage 202 through which the liquid beverage can flow out of the container C in a state where the container C is inclined and a second fluid passage 204 through which the liquid beverage can be sucked in a state where the container C vertically stands. When drawing the beverage through the first fluid passage 202, the outer air flows in through the second fluid passage 204. When dispensing the beverage through the second fluid passage 204, the outer air flows in through the first fluid passage 202.

The first fluid passage 202 is integrally formed with the main body 100 and includes a spout 206 upwardly protruded out of the main body 100. The spout 206 is provided with a central hole for discharging the contents of the container C.

The second fluid passage 204 includes a small diameter of an outflow tube 210 mounted inside of the central hole 208. The outflow tube 210 is protruded upward from the first fluid passage 202 by a predetermined length, and the outflow tube 210 communicates the top end of the first fluid passage 202 to the bottom end of the container C.

Figure 11:
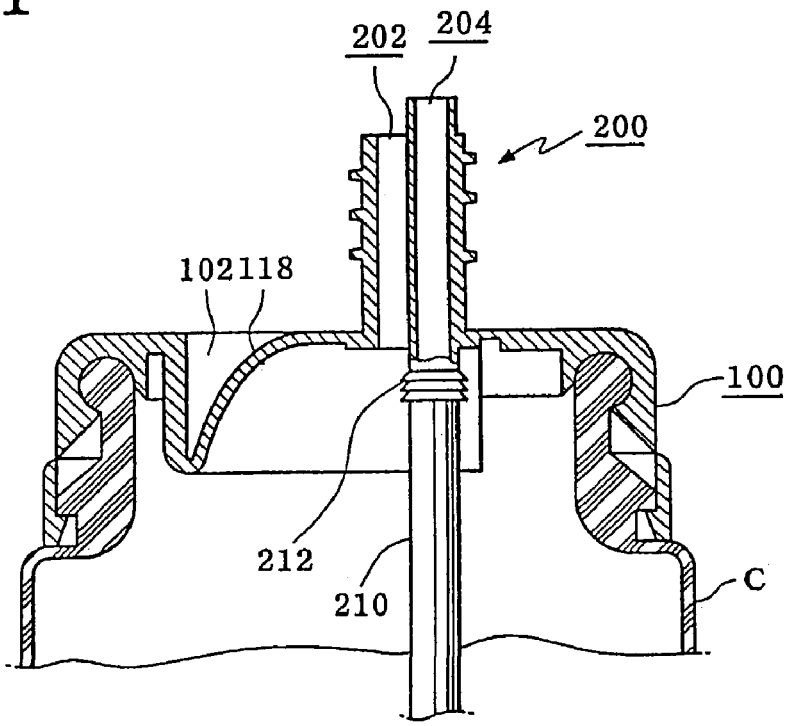
FIGS. 11 to 13 are sectional views of an outflow means in a first embodiment according to the present invention.

The outflow tube 210 is made from a flexible synthetic resin, or is formed with a bellows bending portion 212 as shown in FIG. 11.

Figure 12:
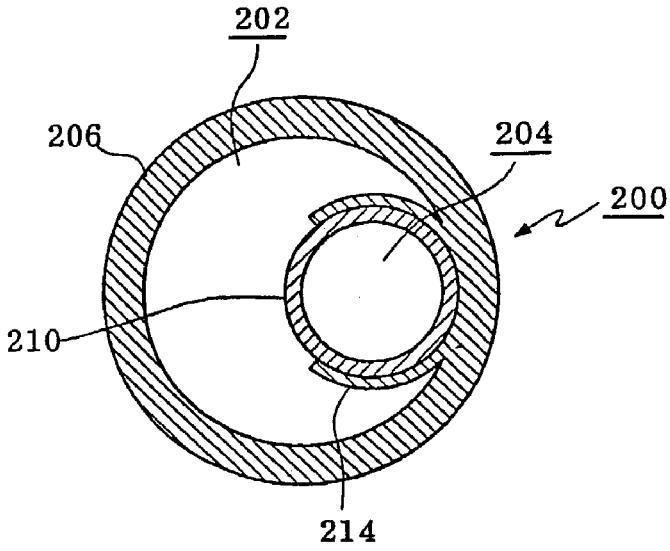

Further, as shown in FIG. 12, the outflow tube 210 is disposed into the first fluid passage 202 in state of interposing a supporting member 214. At this point, the outflow tube 210 can be a straw.

Figure 13:
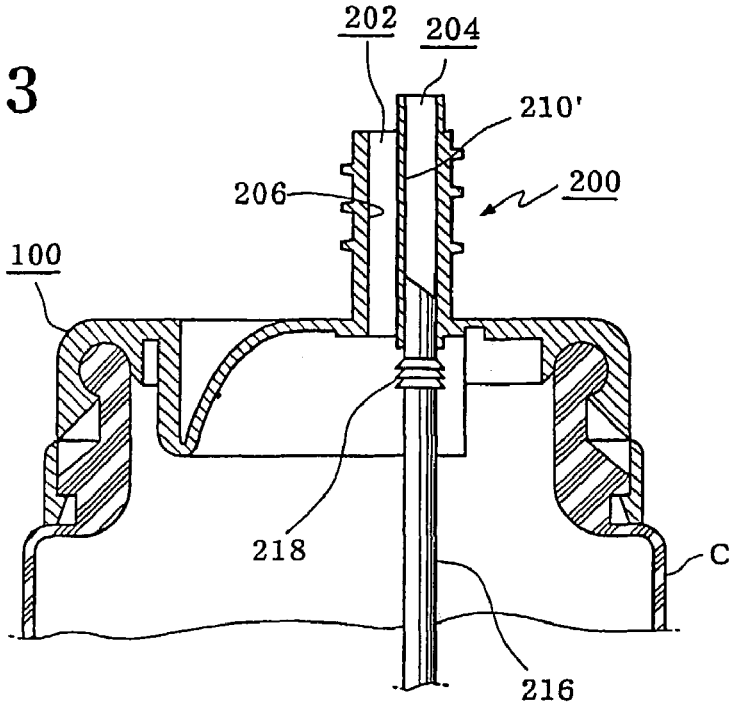

FIG. 13 shows another embodiment of the second fluid passage 204. The second fluid passage 204 is designed such that an upper outflow tube 210' is fixed to the interior of the first outflow tube 202 and a straw 216 is inserted into the interior of the upper outflow tube 210', and the straw 216 is formed with a bellows bending portion 218.

The outflow means 200 is sealed by a cap 330 for preventing the beverage contained in the container from being flowed out. The cap 300 is threaded with the outer circumference of the outflow tube 206 and the bottom end of the cap 300 is extended to the bottom end of the outflow means 200 so as to prevent a pollution of the outflow means 200.

The cap 300 is provided at its bottom end portion with an opening identification skirt 304 divided by a cutting line 302. The opening identification skirt 304 is provided with an engagement jaw at a protrusion **206*a* formed on a lower outer circumference of the outflow tube 206**.

Figure 1:
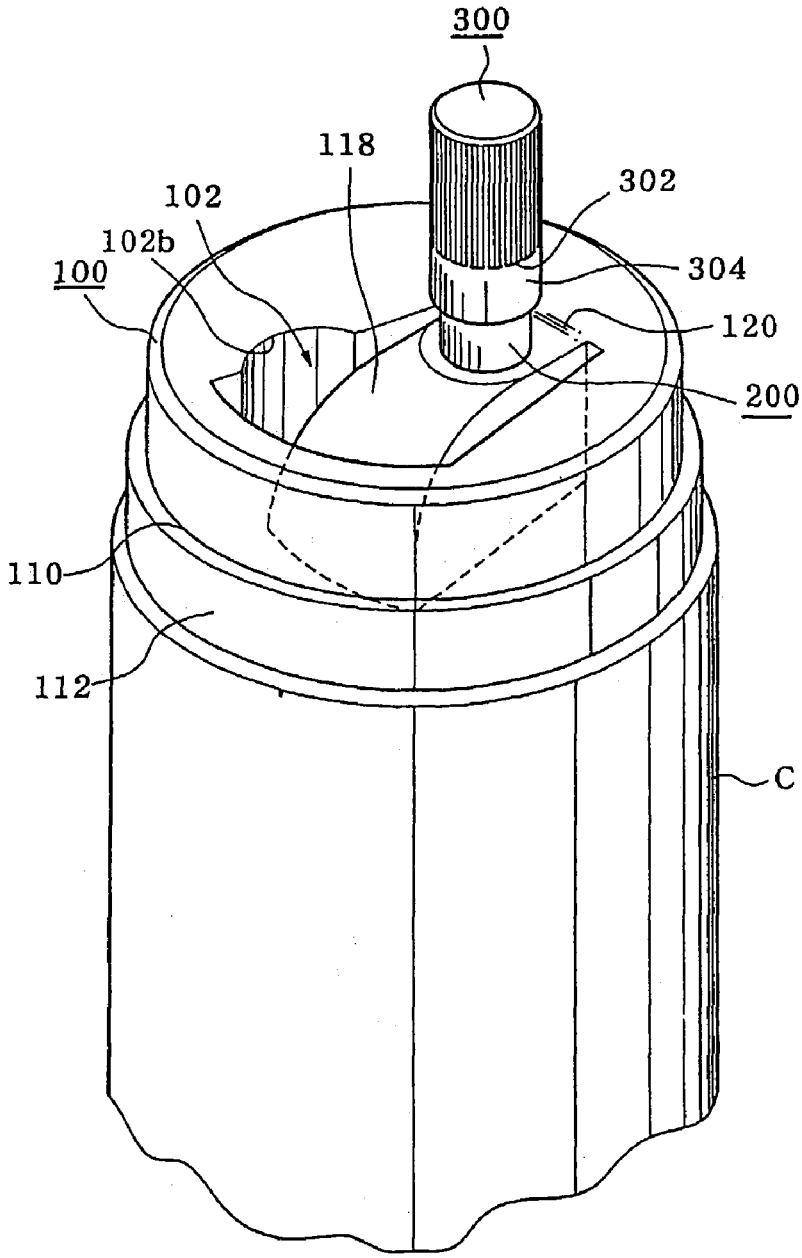
FIGS. 1 to 4 are perspective views and sectional views of a spout assembly in a first embodiment according to the present invention.
Figure 2:
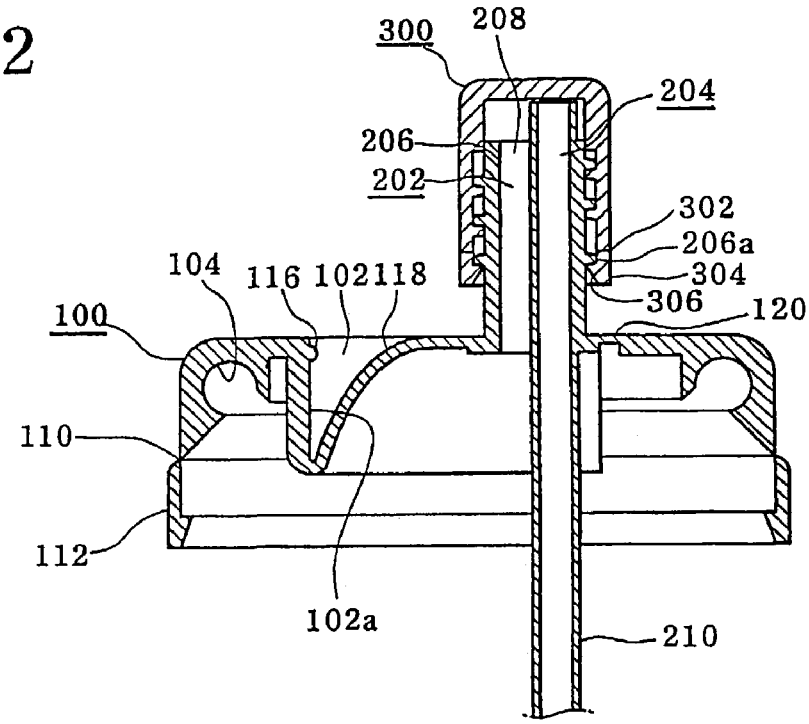
Figure 3:
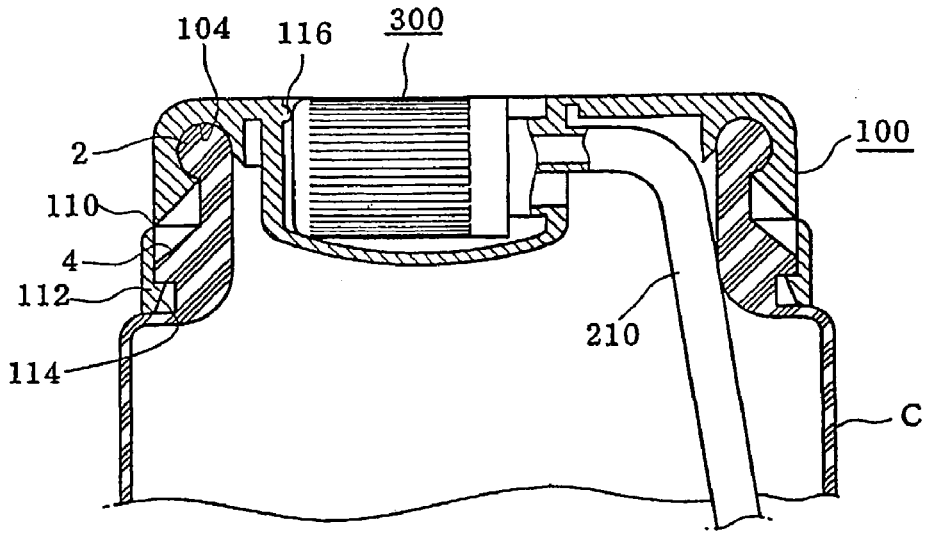
Figure 4:
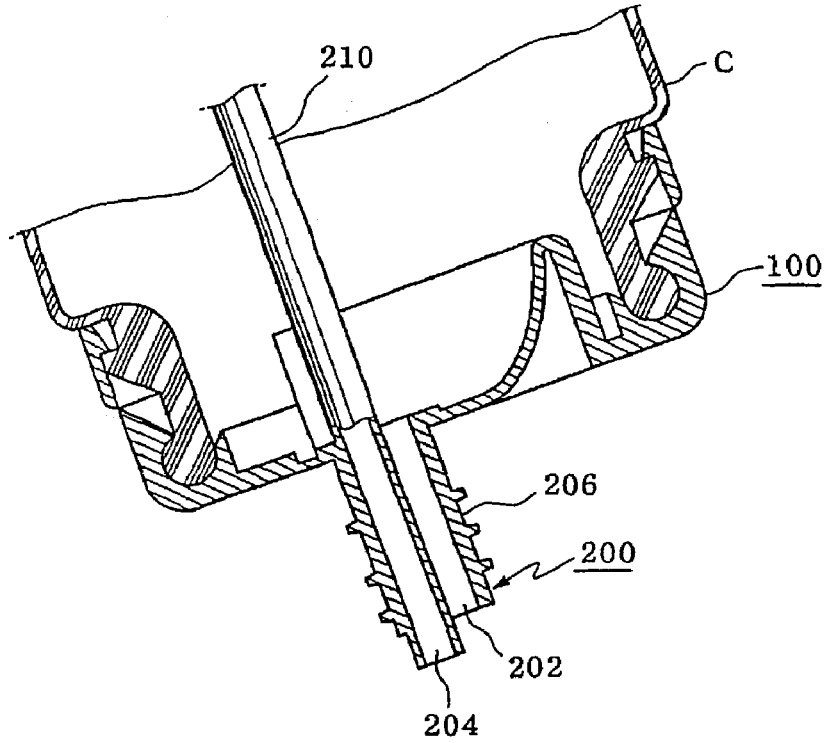

The outflow means 200 coupled with the cap 300 is folded into a concave space 102 of the main body 100 by a bending means(see FIG. 3), or is vertically erected(see FIGS. 1 and 2).

The cap 300 and the outflow means 200 received in the concave space 102 is prevented from being removed by an elastic protrusion 116 disposed at a side wall of the space 102. The elastic protrusion 116 has a size that the cap 300 can be flexibly separated from the protrusion 116 so that the user can easily pull out the cap 300. A groove **102*b* is formed at a side of the concave space 102**.

The bending means for bending or erecting the outflow means 200 includes a bending margin portion 118 for bending the outflow means 200 and a bending border portion 120 connected between the main body 100 opposite to the bending margin portion 118 and the outflow means 200 thereby being a bending axis of the outflow means 200.

Figure 14:
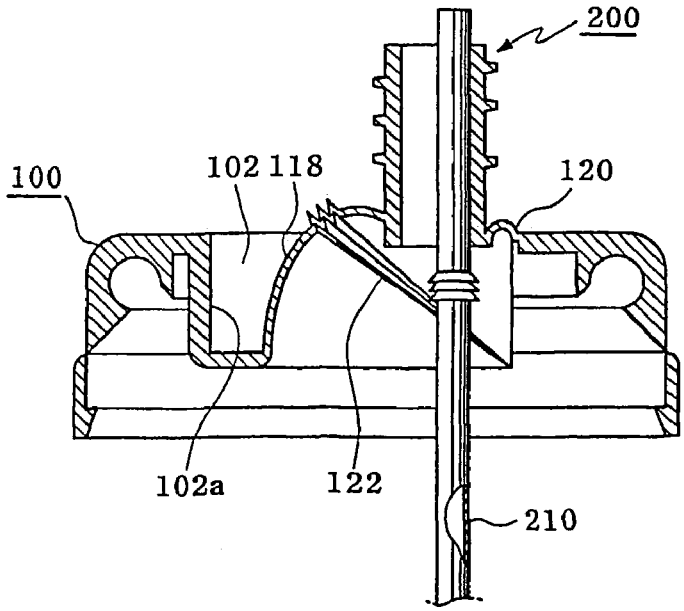
FIGS. 14 to 16 are sectional views of a bending means in a first embodiment according to the present invention.
Figure 15:
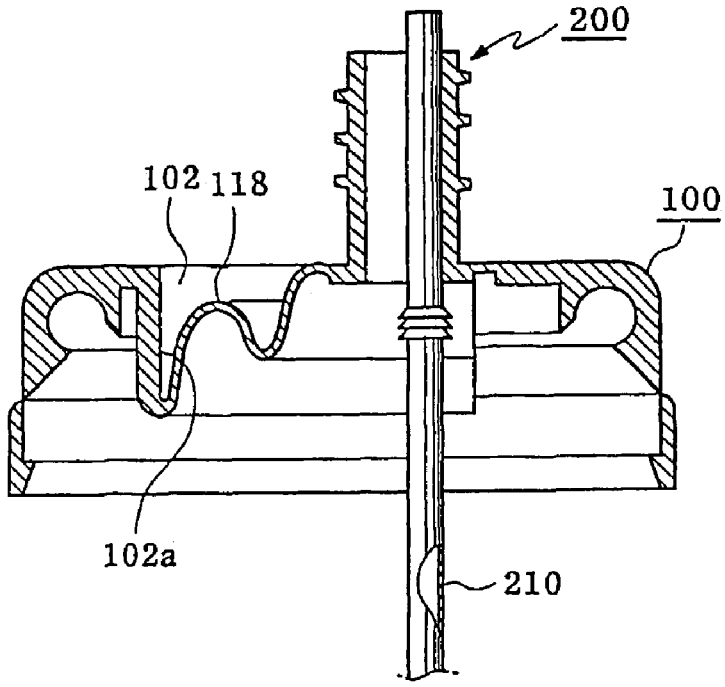

As shown in FIGS. 2, 14 and 15, the bending margin portion 118, is connected between a side wall forming a concave space 102 of the main body 100 and the outflow means 200, and is composed of a bottom surface of the concave space 102 and side wall when the outflow means 200 is bent in a direction.

Further, the bending margin portion 118 is formed at a side with a folding portion 122 for easily achieving a bending operation of the outflow means 200.

Figure 16:
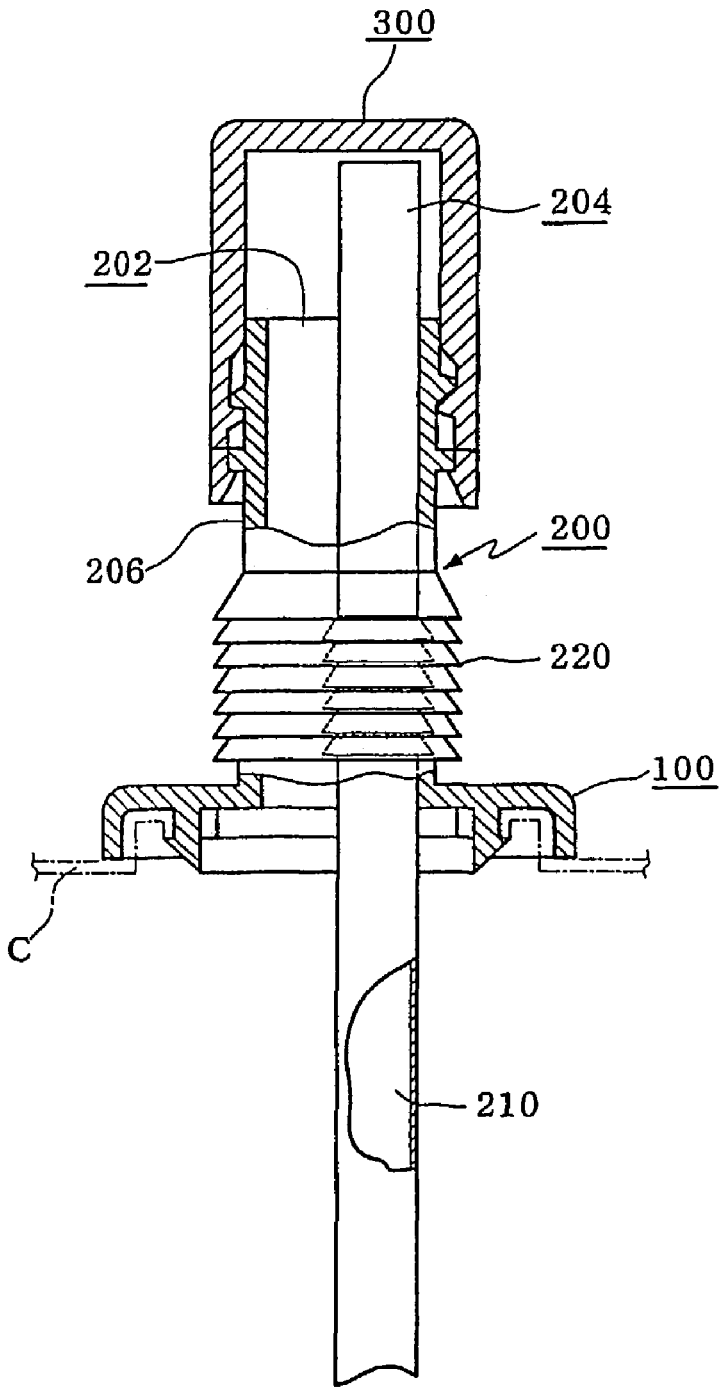

FIG. 16 shows another embodiment of the bending means. The bending means is formed at a bottom of the outflow means 200 with a bellows bending portion 220 thereby accomplishing a bending operation. In this case, the main body 100 is couple with a punching opening of the container C shown in FIG. 10. It is preferred to stick a fixing sticker to the main body 100 and the outflow means 200.

SECOND EMBODIMENT

Figure 17:
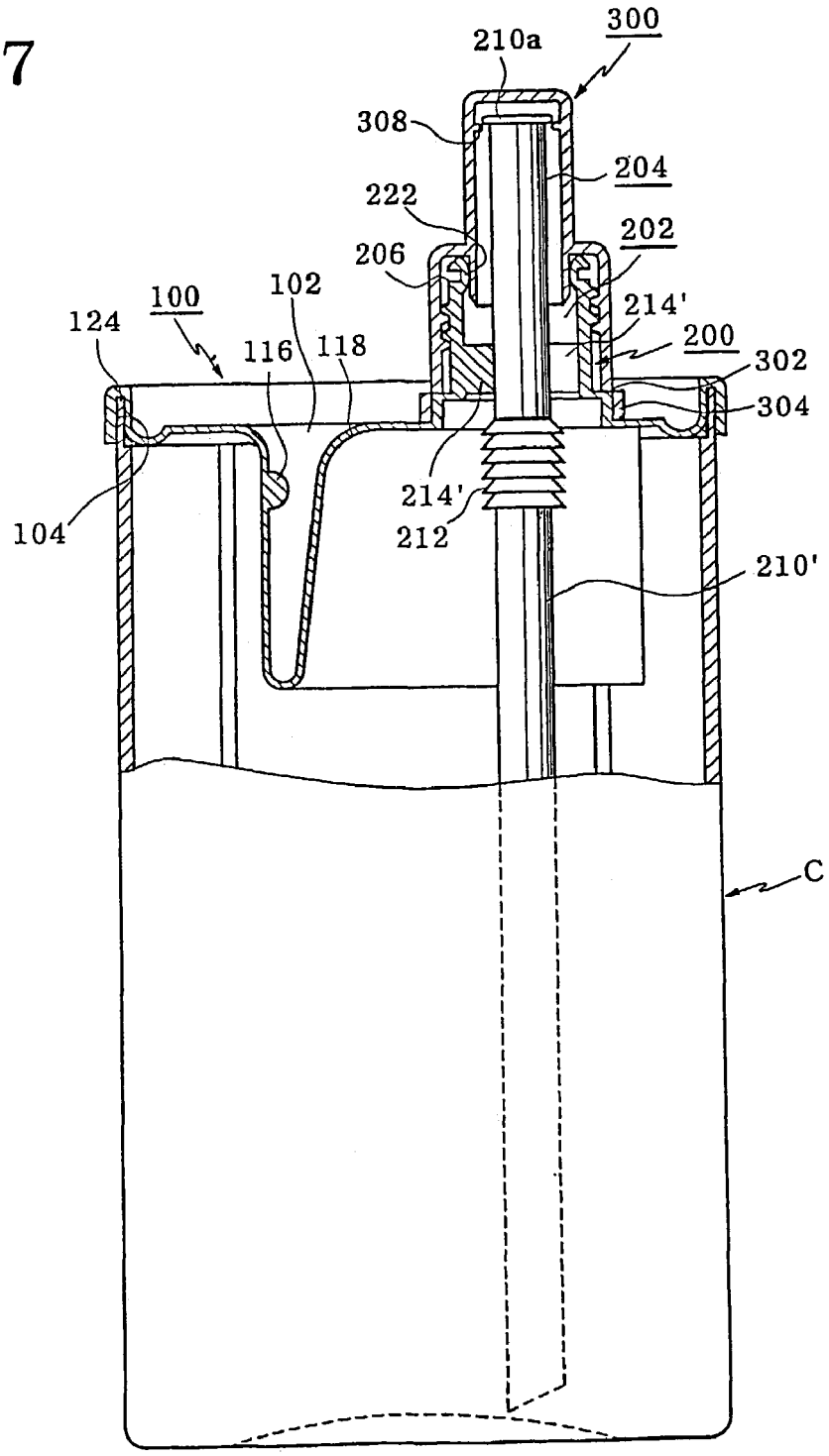
FIGS. 17 to 19 are partly section views of a spout assembly in a second embodiment according to the present invention.
Figure 18:
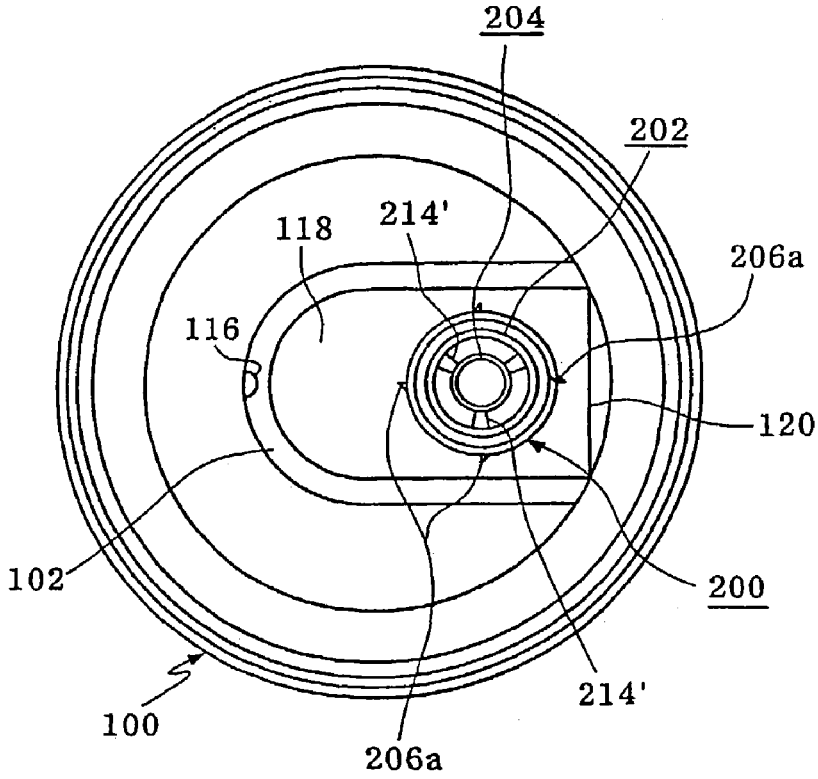
Figure 19:
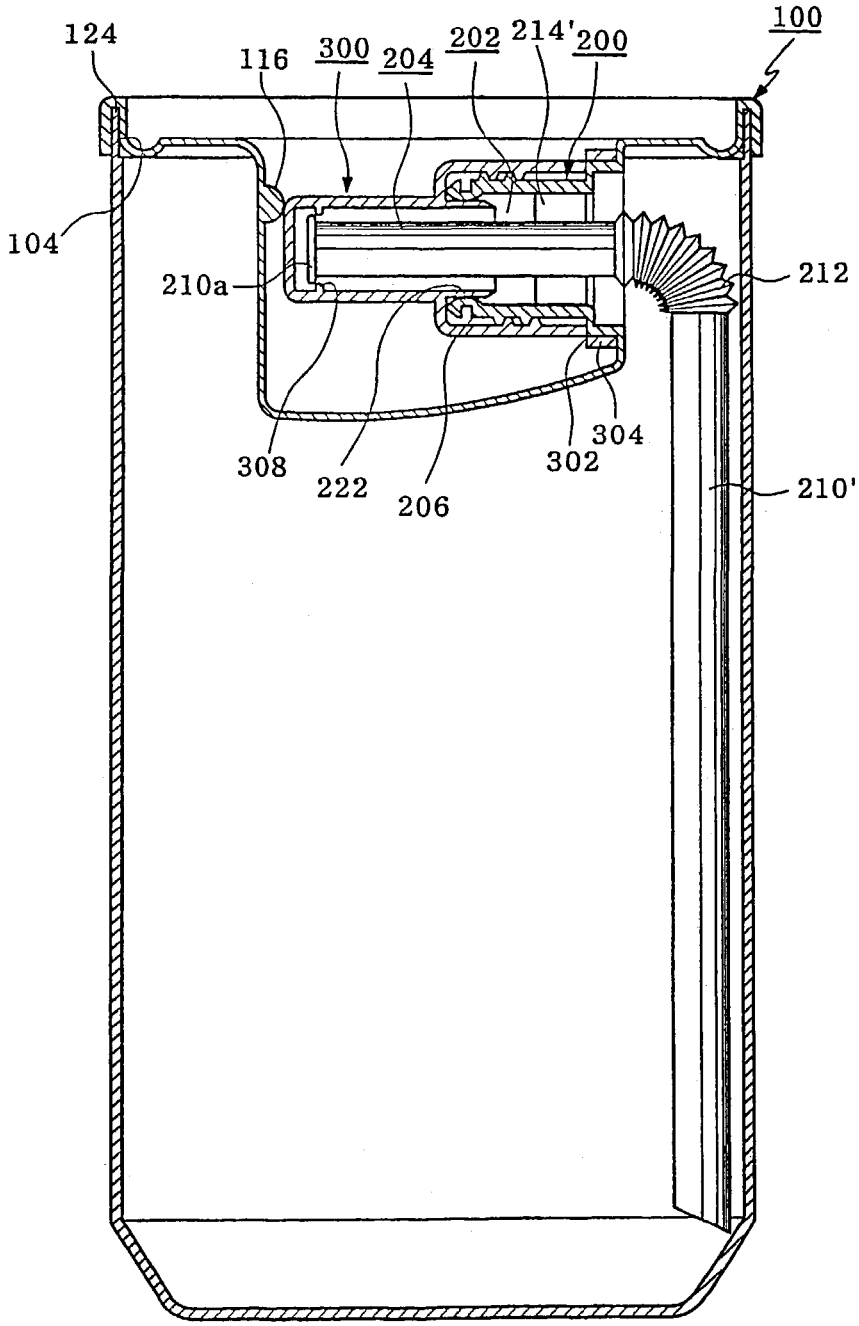

FIGS. 17 to 19 show another embodiment of the present invention.

The spout assembly having a plurality of fluid passages comprises a main body 100 assembled therewith or integrally formed therewith, an outflow means 200 that is upwardly protruded when the outflow means is erected and is received in an inner space 102 of the main body 100 when the outflow means is bent in a direction, and a cap 300 threadedly coupled to the outflow means 200.

Figure 20:
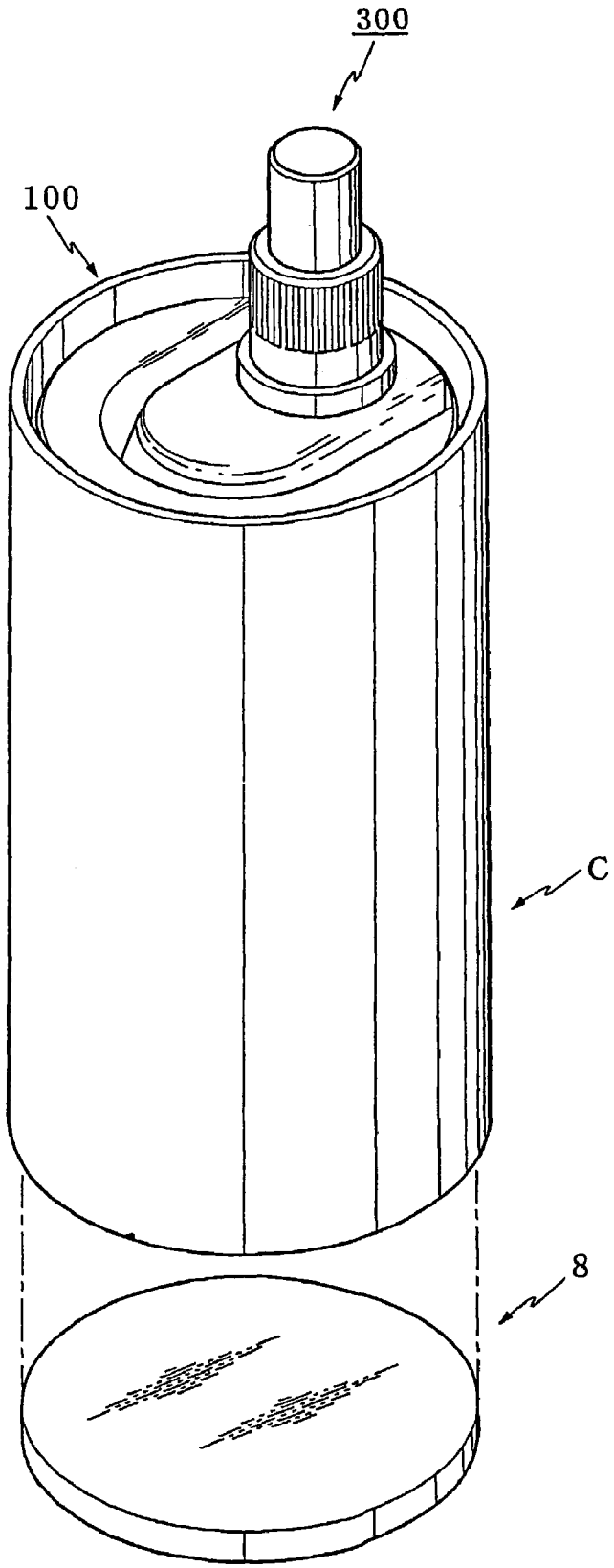
FIG. 20 is a perspective view where a spout assembly of a second embodiment is coupled to a container.

The main body 100 is provided with an annular frame 124 and sealed with an opening upper end portion of the container C. The main body 100 can be integrally formed with the container C as shown in FIG. 20. At this point, the bottom end opening of the main body 100 is sealed with a bottom cover 8.

The outflow means 200 includes a first fluid passage 202 where the user draws a beverage contained in the container C, and a second fluid passage 204 where the user dispenses the beverage of the container C when the container C is inclined.

The first fluid passage 202 is integrally formed with the main body 100 and includes a spout 206 upwardly protruded out of the container C.

The second fluid passage 204 is supported by a supporting means 214' in the first fluid passage 202 and includes an operating outflow tube 210' upward or downward movably mounted thereto. The operating outflow tube 210' communicates from the top end of the outflow tube 210' to the bottom end of the container C. An outer protrusion 210*a* of the top end of the operating outflow tube 210' is elastically engaged and fixed with an inner protrusion 308 of the cap 300 whereby the operating outflow tube 210' moves upwardly by a predetermined length while opening the cap 300. It is preferred that at least three supporting members 214 are disposed at a regular intervals around a circumference thereof.

The operating outflow tube 210 is made from a flexible synthetic resin or is formed at its lower side with a bellows bending portion 212 for easily bending the outflow means 200.

Figure 21:
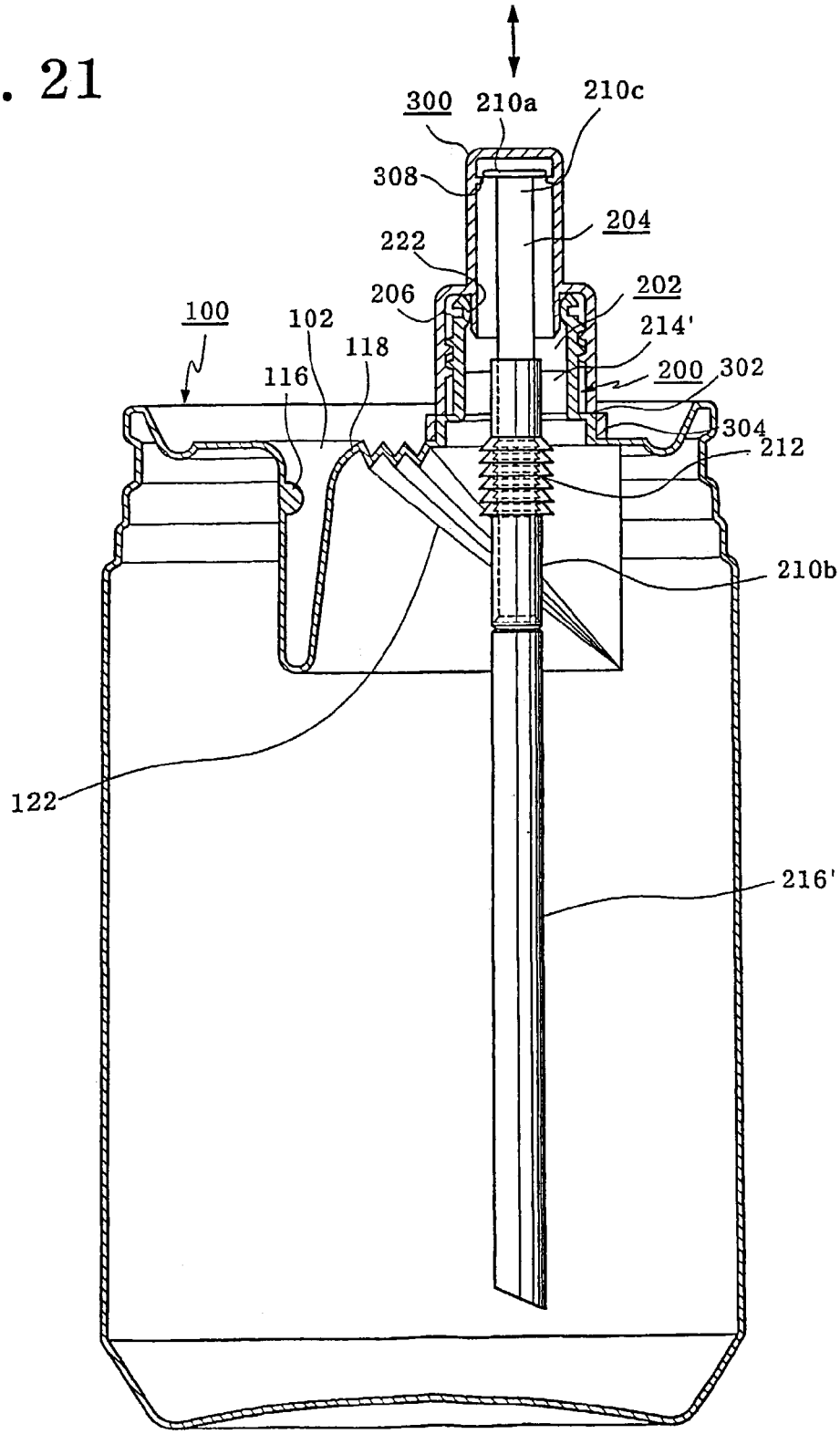
FIG. 21 is a sectional view of a bending means in a second embodiment according to the present invention.

FIG. 21 shows another embodiment of the second fluid passage 204. The second fluid passage 204 is composed of a lower outflow tube 210*b* fixed by the supporting member 214' and a movable outflow tube 210*c* inserted into the lower outflow tube 210*b* and upwardly and downwardly moves, and the lower outflow tube 210*b* is formed with the bellows bending portion 212. Further, a straw 216' can be inserted into the lower outflow tube 210*b*.

The cap 300 is threaded with an outer circumference of the spout 206 and includes an opening identification skirt 304 that is divided by a separating guide line 302. The opening identification skirt 304 is provided with an engagement jaw engaged and fixed to a protrusion formed on a lower outer circumference of the spout 206.

At this point, the cap is designed such that an inner small diameter portion 222 is extended to be inserted into the upper end of the spout 206 and tightly sealed with a top inner circumference surface of the spout 206.

The outflow means 200 coupled with the cap 300 is folded in the concave portion 102 of the main body 100 and prevented from being removed by an elastic protrusion 116 disposed in the side wall of the space 102.

The bending means includes a bending margin portion 118 for accomplishing a bending operation of the outflow means 200 and a bending border portion 120 that is connected between an opposite main body 100 from the bending margin portion 118 and the outflow means 200 thereby being a bending axis of the outflow means 200.

The bending margin portion 118 is formed with a folding portion 122 for easily bending the outflow means 200.

Figure 22:
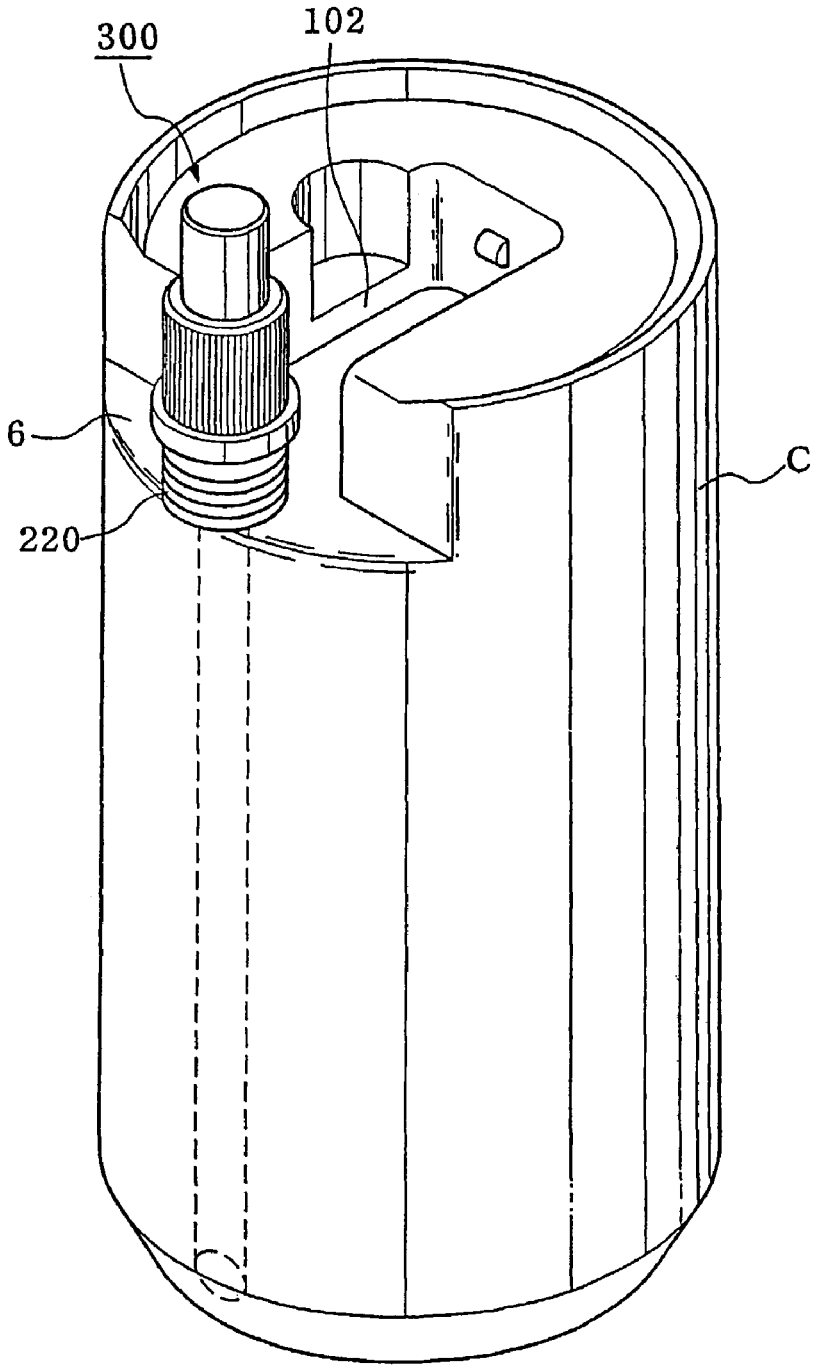
FIGS. 22 and 23 are perspective views of a spout assembly in a second embodiment according to the present invention.

FIG. 22 shows another embodiment of the bending means. The bending means is formed with a bellows bending portion 220 at the bottom of the outflow means 200. In this case, the main body 100 adheres to a punching hole of the container C. The main body is not provided with a space for receiving the outflow means 200.

In this case, the spout assembly of the present invention is mounted on a cut end portion 6 of the container C, and is received in a space 102' formed on the container C while bending the spout assembly with the bellows bending portion 220.

Figure 23:
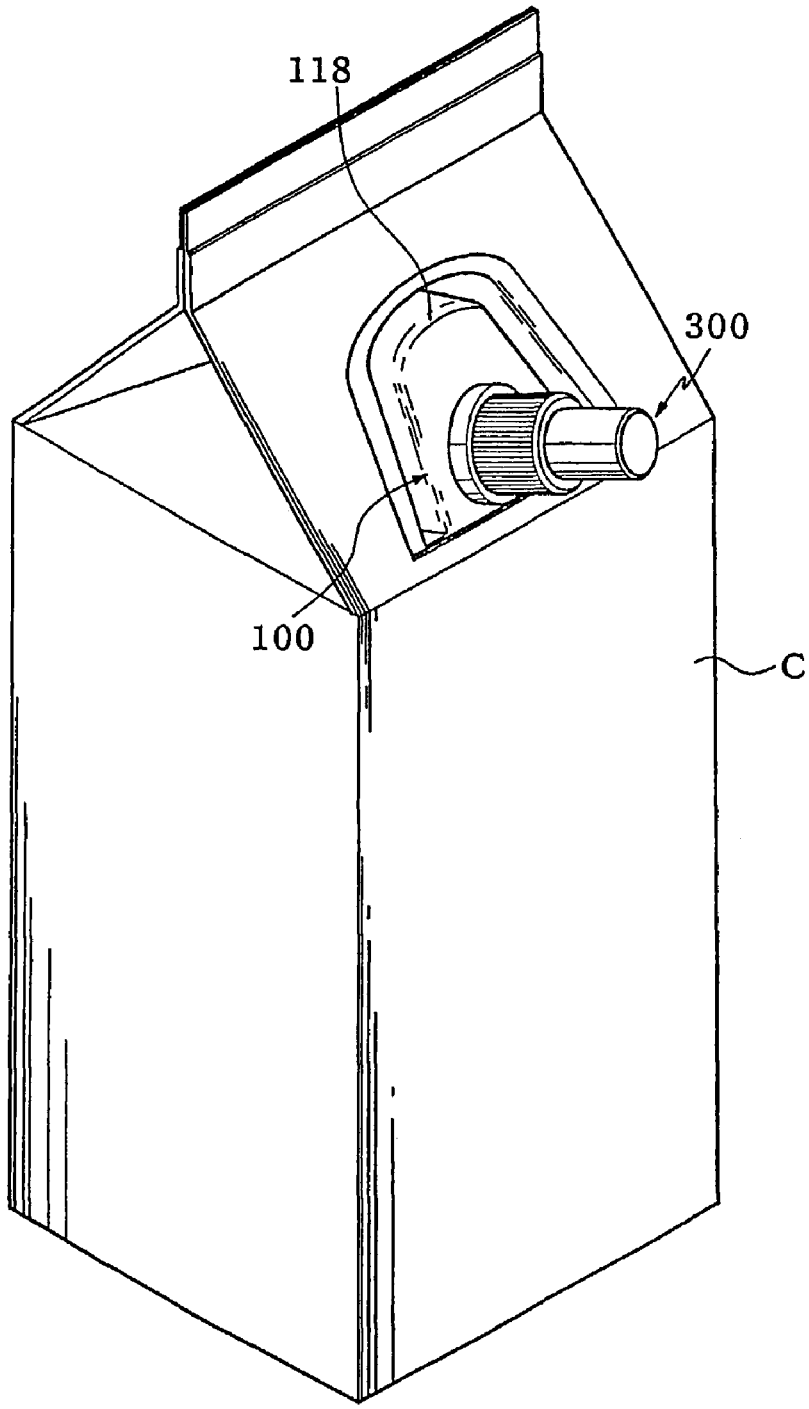

FIG. 23 shows another embodiment of the container C. The container C can be a cartoon pack or a synthetic resin pack.

THIRD EMBODIMENT

Figure 24:
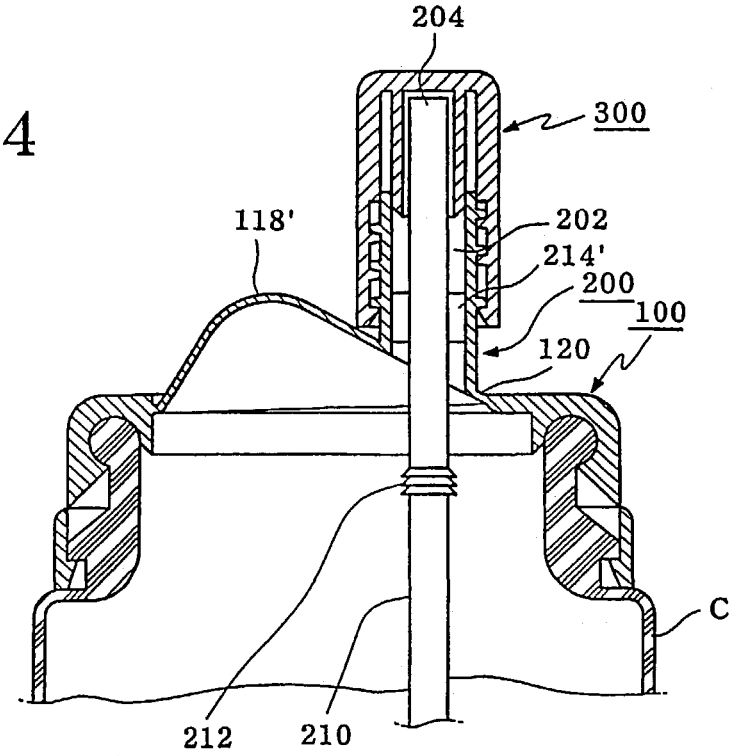
FIGS. 24 and 25 are perspective views of a spout assembly in a third embodiment according to the present invention.
Figure 25:
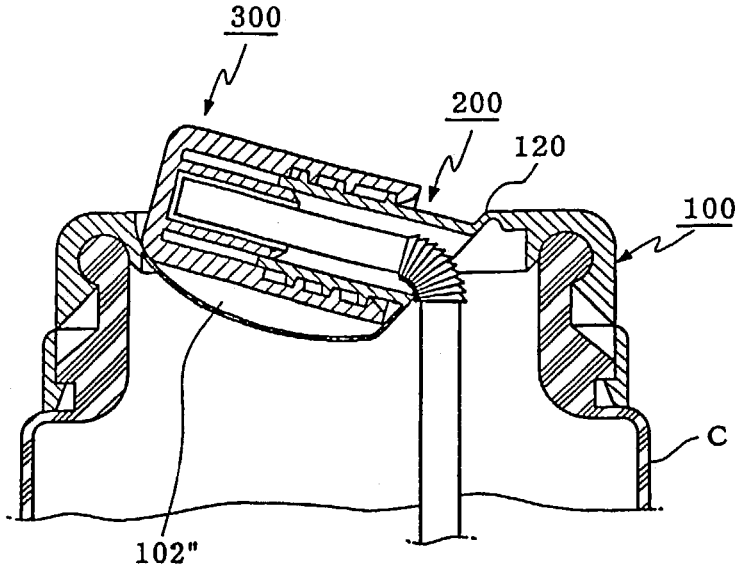

FIGS. 24 and 25 shows another embodiment of the present invention. The spout assembly having a plurality of fluid passages comprises a main body 100 assembled or adhered to the container C, an outflow means 200 upward protruded from the main body 100 and received in an upper space 102", and a cap 300 threaded and sealed with the outflow means 200.

The construction of the main body, the outflow means 200 and the cap is similar to that of the first and second embodiments. But a space 102" for receiving the outflow means 200 coupled with the cap 300 and a means for bending the outflow means are different.

The bending means includes a bending margin portion 118' that is upward protruded from the end of the main body 100 and a bending border portion 120 that is connected between an opposite main body 100 from the bending margin portion 118' and the outflow means 120 thereby being a bending axis of the outflow means. The bending margin portion 118' is upwardly and downwardly protruded from the end of the main body 100. The outflow means 200 can be slightly tilted and a portion of the outflow means is received in the main body 100. It is preferred that a fixing sticker is stuck to the cap 300 coupled to the outflow means 200 and the main body 100.

Figure 26:
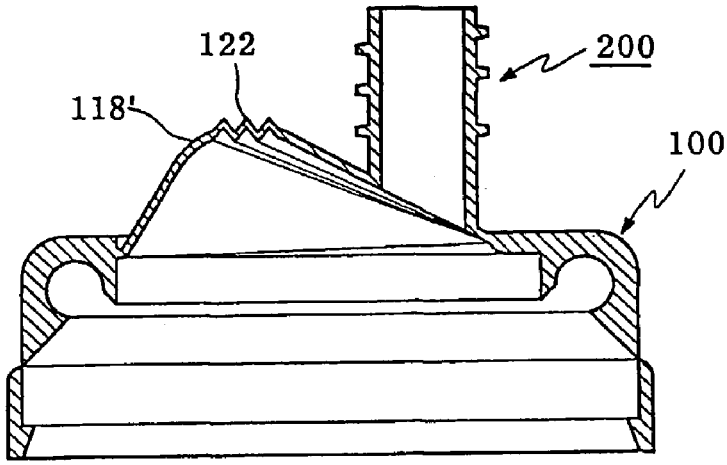
FIG. 26 is a sectional view of a bending means in a third embodiment according to the present invention.

As shown in FIG. 26, the bending margin portion 118' is provided with a folding portion 122.

Figure 27:
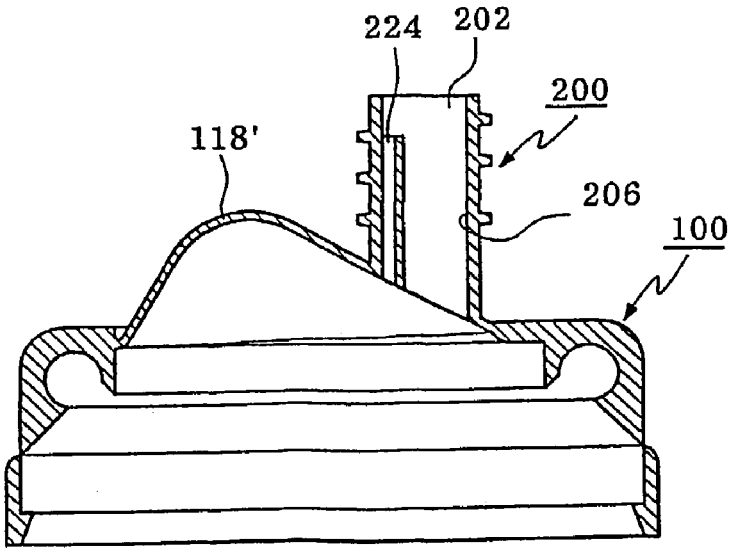
FIG. 27 is a sectional view of an outflow means in a third embodiment according to the present invention.

In FIG. 27, an air inflow hole 224 is formed in the first fluid passage 202, especially, to the outflow tube 206. The airflow hole 224 is for easily dispensing the beverage of the container by supplying the outer air therethrough.

Figure 28:
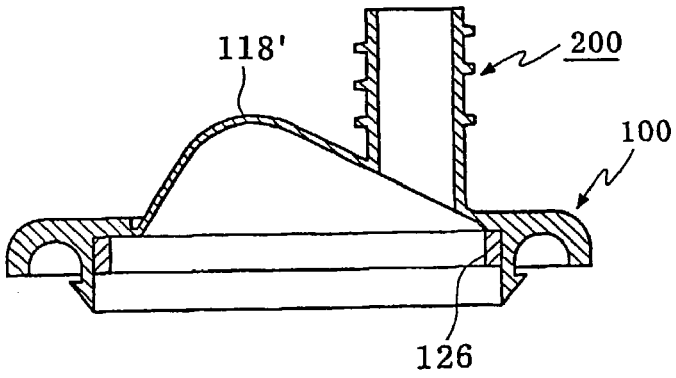
FIG. 28 is a sectional view of a main body in a third embodiment according to the present invention.

FIG. 28 shows where a reinforcement frame 126 is provided to the main body 100 for tightly sealing the main body 100 and the container.

FOURTH EMBODIMENT

Figure 29:
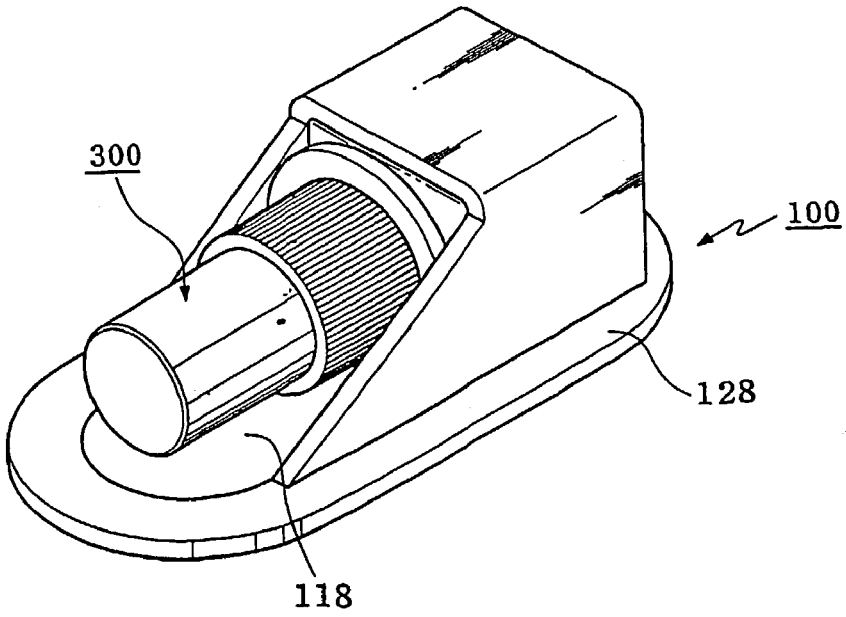
FIGS. 29 to 31 are perspective views of a spout assembly in a fourth embodiment according to the present invention.
Figure 30:
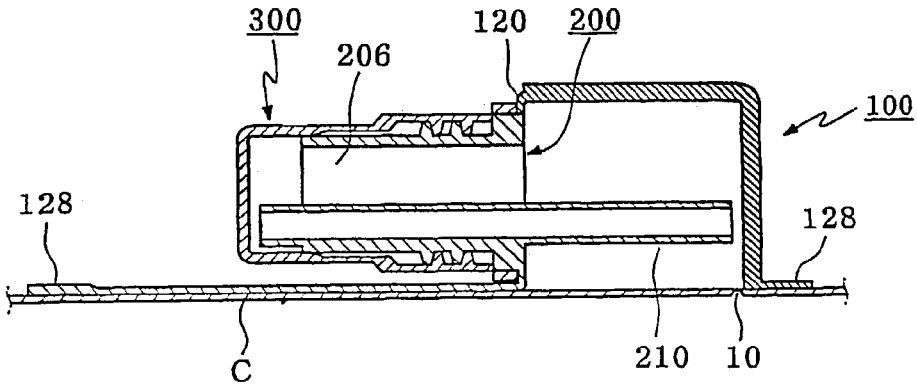
Figure 31:
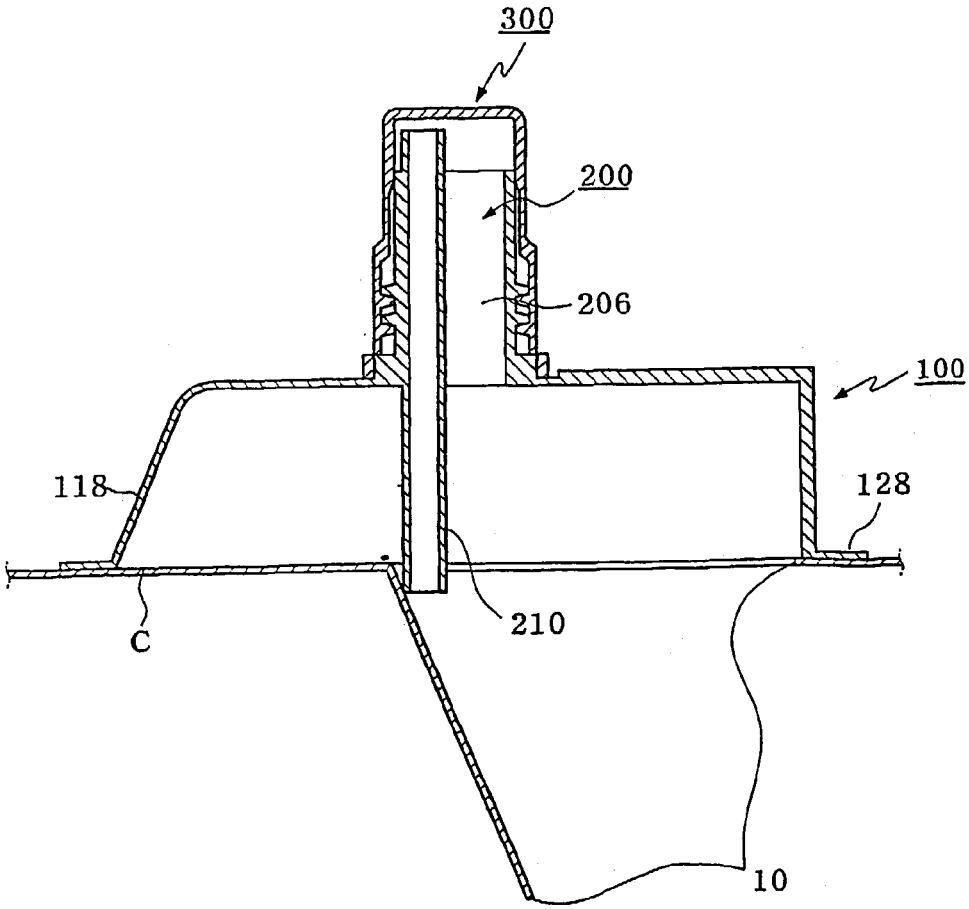

FIGS. 29 and 30 shows another embodiment of the spout assembly according to the present invention.

The spout assembly having a plurality of fluid passages comprises a main body adhered to the top of the container C, an outflow means 200 upwardly protruded from the main body 100 and a cap 300 threaded and sealed with the outflow means 200.

The main body 100 is stuck to a sealed container C. Therefore, as the outflow means 200 is erected, the container C is cut and opened. A lower rounding surface 128 is stuck to the beverage container C. The main body 100 comprises a bending margin portion 118" upwardly protruded from the main body 100, and a bending border portion 120 that is connected between an opposite main body 100 from the bending margin portion 118" and the outflow means 200 thereby being a bending axis of the outflow means 200.

As the outflow means 200 is vertically erected, the bottom end of the outflow tube 210 presses the container C and cuts a cutting line 10 so that the beverage can flows out.

While this invention has been described in connection with what is presently considered to be the most practical and referred embodiments; it is to be understood that the invention is not limited to the disclosed embodiments, but, on the contrary, is intended to cover various modifications and equivalent arrangements included within the spirit and scope of the appended claims.

The invention claimed is:

1. A spout assembly having a plurality of fluid passages comprising:

a main body coupled to an opening of a container;

the main body comprising an outflow means having a first fluid passage through which a liquid beverage can flow out of the container in a state where the container is in an inclined discharge position and a second fluid passage through which a liquid beverage can be sucked in a state where the container is in a vertical discharge position;

a cap coupled removably to the outflow means; and the outflow means being rotatable with respect to a vertical axis of the container;

the second fluid passage being fixed within a circumference of the first fluid passage, wherein the main body includes an opening identification skirt which is divided by a separating guide line and is provided with an engagement jaw engaged and fixed to a top end of the container.

2. The spout assembly having a plurality of fluid passages as claimed in claim 1, wherein the main body includes an inserting groove where the top end of the container is inserted and seal-coupled.

3. The spout assembly having a plurality of fluid passages as claimed in claim 1, wherein the main body adheres to the container.

4. The spout assembly having a plurality of fluid passages as claimed in claim 1, wherein the main body is integrally molded by an inserting manner to the top end of the container.

5. The spout assembly having a plurality of fluid passages as claimed in claim 1, wherein the main body is integrally molded with the container.

6. The spout assembly having a plurality of fluid passages as claimed in claim 1, wherein the main body is provided with a space for receiving the outflow means bent by way of a bending means.

7. The spout assembly having a plurality of fluid passages as claimed in claim 6, wherein the main body is provided with an elastic protrusion for preventing the cap and the outflow means from being erected while bent to the side wall of the space and the elastic protrusion has a suitable size to elastically pass the cap.

8. The spout assembly having a plurality of fluid passages as claimed in claim 1, wherein the second fluid passage is supported by a supporting means in the first fluid passage and includes an operating outflow tube upward or downward movably mounted thereto, the operating outflow tube communicates from the top end of the first fluid passage to the bottom end of the container, an outer protrusion of the top end of the operating outflow tube is elastically engaged and fixed with an inner protrusion of the cap whereby the operating outflow tube moves upwardly by a fixed distance while opening the cap.

9. The spout assembly having a plurality of fluid passages as claimed in claim 8, wherein the operating outflow tube is formed with a bellows bending portion.

10. The spout assembly having a plurality of fluid passages as claimed in claim 8, wherein the operating outflow tube is made from a flexible synthetic resin.

11. The spout assembly having a plurality of fluid passages as claimed in claim 8, wherein the operating outflow tube is composed of a lower outflow tube fixed by the supporting member and a movable outflow tube inserted into the lower outflow tube and upwardly and downwardly moves, and the lower outflow tube is formed with a bellows bending portion.

12. The spout assembly having a plurality of fluid passages as claimed in claim 1, wherein the cap is threaded with an outer circumference of the outflow means and includes an opening identification skin that is divided by a separating guide line and is provided with an engagement jaw engaged and fixed to the main body.

13. The spout assembly having a plurality of fluid passages claimed in claim 1, wherein the outflow means is rotatable by way of a bellows bending portion formed on the outflow means.

14. The spout assembly having a plurality of fluid passages as claimed in claim 1, wherein the outflow means is rotatable by way of a bending margin portion that is connected between the main body and the outflow means to accomplish bending of the outflow means and a bending border portion that is connected between an opposite main body from the bending margin portion and the outflow means thereby being a bending axis of the outflow means.

15. The spout assembly having a plurality of fluid passages as claimed in claim 14, wherein the bending margin portion is formed with a folding portion.

16. The spout assembly having a plurality of fluid passages as claimed in claim 14, wherein the bending margin portion, is connected between a side wall forming a concave space of the main body and the outflow means, and is composed of a bottom surface of the concave space and the side wall while the outflow means is bent in a direction.

17. The spout assembly having a plurality of fluid passages as claimed in claim 14, wherein the bending margin portion is upwardly protruded from an end portion of the main body, and the outflow means is tilted while it is bent.

18. The spout assembly having a plurality of fluid passages as claimed in claim 17, wherein a fixing sticker is stuck to the outflow means and the top surface of the main body.

19. The spout assembly having a plurality of fluid passages as claimed in claim 1, wherein the spout is formed at its inside with an air inflow hole.

20. The spout assembly having a plurality of fluid passages as claimed in claim 1, wherein the outflow tube is formed with a bellows bending portion.

21. The spout assembly having a plurality of fluid passages as claimed claim 1, wherein the outflow tube is made from a flexible synthetic resin.

22. The spout assembly having a plurality of fluid passages as claimed in claim 1, wherein said second fluid flow passage is composed of an upper outflow tube and a straw inserted thereinto, and the straw is formed with a bellows bending portion.

23. The spout assembly having a plurality of fluid passages as claimed in claim 1, wherein the outflow tube is disposed into the first outflow passage in state of interposing a supporting member.

* * * * *